US011150048B1

(12) United States Patent
Stephens

(10) Patent No.: US 11,150,048 B1
(45) Date of Patent: Oct. 19, 2021

(54) FIREARM BUTTSTOCK HAVING MAGAZINE STORAGE

(71) Applicant: Lee W. Stephens, Panama City, FL (US)

(72) Inventor: Lee W. Stephens, Panama City, FL (US)

(73) Assignee: Ghoststar LLC, Panama Beach City, FL (US)

( * ) Notice: Subject to any disclaimer, the term of this patent is extended or adjusted under 35 U.S.C. 154(b) by 0 days.

(21) Appl. No.: 17/132,291

(22) Filed: Dec. 23, 2020

(51) Int. Cl.
*F41C 23/22* (2006.01)

(52) U.S. Cl.
CPC ..... *F41C 23/22* (2013.01)

(58) Field of Classification Search
CPC ..... F41C 23/22
See application file for complete search history.

(56) References Cited

U.S. PATENT DOCUMENTS

2011/0099872 A1* 5/2011 Bentley ..... F41C 23/22 42/71.01
2015/0276343 A1* 10/2015 Zusman ..... F42B 39/02 42/71.01
2016/0097613 A1* 4/2016 Lamb ..... F41C 23/22 42/71.01
2018/0216904 A1* 8/2018 Noonan ..... F41C 23/22

* cited by examiner

*Primary Examiner* — J. Woodrow Eldred
(74) *Attorney, Agent, or Firm* — James M. Duncan; Scanlon Duncan LLP

(57) ABSTRACT

A buttstock for a rifle has one or two longitudinal slots into which spare ammunition magazines may be inserted, stored, carried, and available for optional use in either a rifle or a pistol configured to receive the ammunition magazine. When fully inserted into a longitudinal slot, the magazine is fully enclosed within the buttstock except for the bottom surface of the magazine, which is approximately flush with the rear surface of the buttstock. One model of the buttstock may hold a single magazine, while another may hold two magazines, where the magazine slots are configured in an over-under arrangement.

20 Claims, 8 Drawing Sheets

FIREARM BUTTSTOCK HAVING MAGAZINE STORAGE

BACKGROUND OF THE INVENTION

The present invention relates to firearms and more particularly to buttstocks for firearms and the use of the buttstock for storage and transport of spare ammunition magazines.

It is known to have one or more storage compartments in a firearm buttstock, where the storage compartments are utilized for storage and transport of firearms cleaning kits, accessories, and ammunition. Some firearm stocks are also known for storage and transport of additional magazines as may be required for law enforcement, hunting or target shooting.

With respect to specific firearms, GLOCK manufactures rifles and pistols, both of which are capable of using the same ammunition magazines as between rifles and pistols. Among other types of ammunition, these magazines are capable of holding 9-millimeter, 40 caliber and 357 Sig (manufactured by SIG Sauer) ammunition. The ammunition is stacked into the magazine with the magazine having a spring which lifts the stack of ammunition as each round is fed into the firing chamber of the firearm. The magazines typically have a capacity of either 16 or 32 rounds, although magazine extensions are available which increase the capacity by one round. The interchangeability of the magazines allows a user to carry spare magazines which may be used in either a pistol or rifle depending upon the need.

Carrying spare magazines for a firearm—either rifle or pistol—typically involves placing the magazines in a vest, belt, or backpack. When so carried, the magazines may be exposed to weather and may not be readily located and accessed.

SUMMARY OF THE INVENTION

Embodiments of the present invention provide a convenient storage and transport mechanism for carrying spare magazines. Embodiments of the invention have specific application to being utilized with GLOCK rifles and for carrying magazines configured for both GLOCK rifles and pistols, where the magazines may carry rounds of ammunition specifically configured to chamber in GLOCK firearms, where the ammunition may include, among other possibilities, 9-millimeter, 40 caliber and 357 Sig. It is to be noted that embodiments of the present invention may be utilized as an aftermarket stock because embodiments of the present invention are interchangeable with existing stocks on firearms having a buffertube.

The presently disclosed buttstock provides a storage and transport solution for military, law enforcement, hunting and target shooting applications. One embodiment of the disclosed buttstock has a front end having an opening which receives a buffertube of a firearm receiver, where the opposite end of the buttstock is designated as the rear end. A longitudinal axis is defined between the front end and the rear end of the buttstock where the longitudinal axis is generally aligned or parallel with the longitudinal axis of the barrel of the firearm.

An embodiment of the buttstock has a first magazine slot which extends from the rear end of the buttstock forward towards the front end, where the first magazine slot is in general parallel alignment with the longitudinal axis. The first slot terminates at a front wall adjacent the front end of the buttstock. The first magazine slot is configured to receive a first ammunition magazine having a top and a bottom, where all but the bottom of the magazine is received within the magazine slot. The ammunition magazine is configured to hold rounds of ammunition disposed in a stacked configuration between the top and the bottom, with the lengths of the rounds in parallel configuration rather than in an-end-to-end configuration. It is to be understood from this description that the terms "top" and "bottom" as applied to the ammunition magazines of this disclosure refer to the orientation of the magazines when loaded into the feed slot of a firearm in preparation of firing, and do not refer to the orientation of the magazine when stored within the buttstock of the present invention. When a magazine is carried in the buttstock of the present invention, any rounds of ammunition in the magazine will be in an approximate perpendicular rather than parallel relationship with the barrel of the firearm.

The above-described configuration demonstrates that the present invention does not provide any provision for feeding ammunition directly into the chamber of the firearm. Rather, the present invention is only for the storage and transport of spare ammunition magazines, whether empty or loaded.

The first magazine slot may be so configured that when a first ammunition magazine is fully disposed within the first magazine slot, the top of the ammunition magazine abuts the front wall defining the terminus of the slot and the bottom of the ammunition magazine is flush or nearly flush with the rear end of the buttstock. Thus, for this embodiment, when a magazine is fully disposed within the magazine slot, the only exposed portion of the magazine is the bottom, thereby providing a convenient storage and transport apparatus for extra firearms magazines, either empty or loaded with ammunition, but where no portion of the magazine is exposed to potentially catch on clothing, brush or the like. Moreover, because the opening at the top of the ammunition magazine is fully received within the first magazine slot, the interior of the magazine is protected from receiving dirt, debris and moisture.

Embodiments of the present buttstock may comprise a second magazine slot which is in parallel alignment with the first magazine slot. The first magazine slot and the second magazine slot may be configured in an "over-under" configuration. Depending upon the location of the first magazine slot and the second magazine slot in the buttstock, the first magazine slot may have a longer length than the second magazine slot, and thus be capable of storing a longer magazine than the second magazine slot. For example, the first magazine slot may receive a 32-round capacity magazine and the second magazine slot may receive a 16-round capacity magazine. I It is to be noted that the standard magazine size for GLOCK firearms is 16 round capacity and 32 round capacity. However extended magazines having a capacity of 17 rounds and 33 rounds are available. Embodiments of the present invention may either be modified to have magazine slots capable of fully receiving the extended magazines, or the extended magazines may be utilized in an embodiment which fully receives the standard sized magazines, but with the understanding that a portion of the bottom of the magazine will extend outwardly from the back of the buttstock.

Embodiments of the present buttstock may also comprise a mechanism which retains the ammunition magazine within the buttstock, but which is readily activated to release the magazine when desired. An embodiment of this mechanism may have a first interior catch which lockingly engages the first ammunition magazine when it is fully disposed within the first magazine slot. This interior catch may bias into an indentation or slot on the magazine by either a spring or by the mechanical properties of the catch itself, wherein the first mechanism releases the first ammunition magazine upon a user depressing an outside surface of the first mechanism.

DETAILED DESCRIPTION OF THE INVENTION

Figure 1:
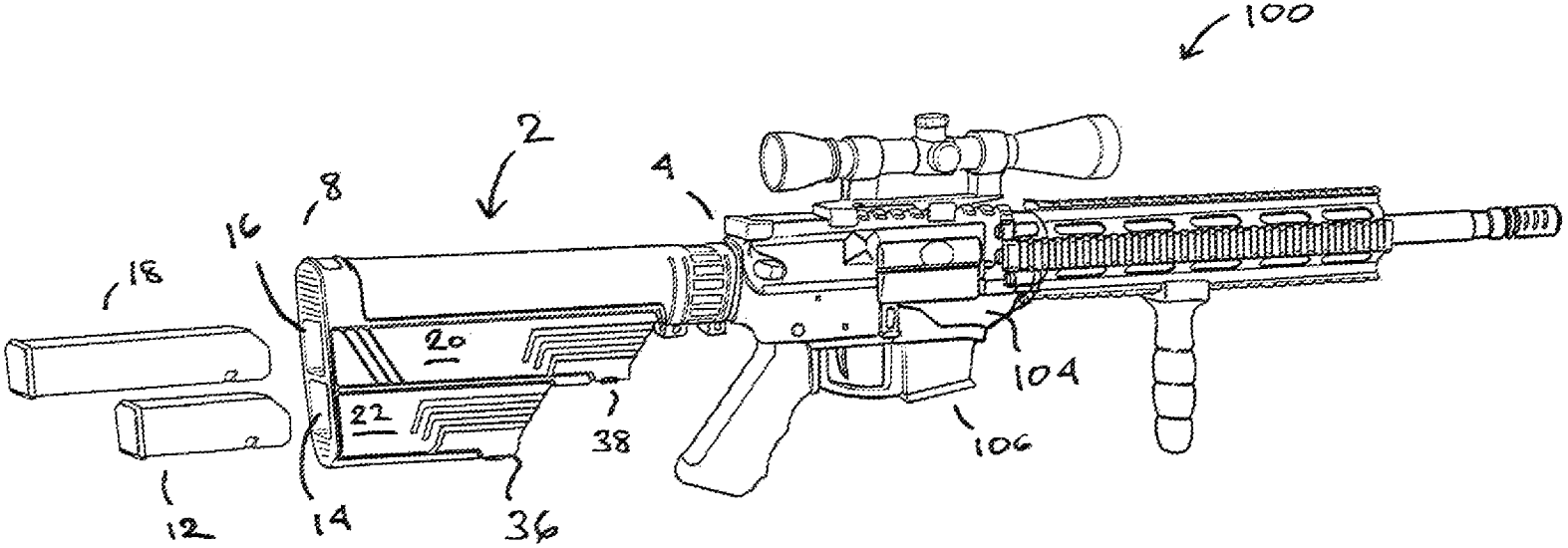
FIG. 1 depicts an embodiment of a firearm having an embodiment of the disclosed buttstock having storage slots for two ammunition magazines, with one magazine removed.
Figure 2:
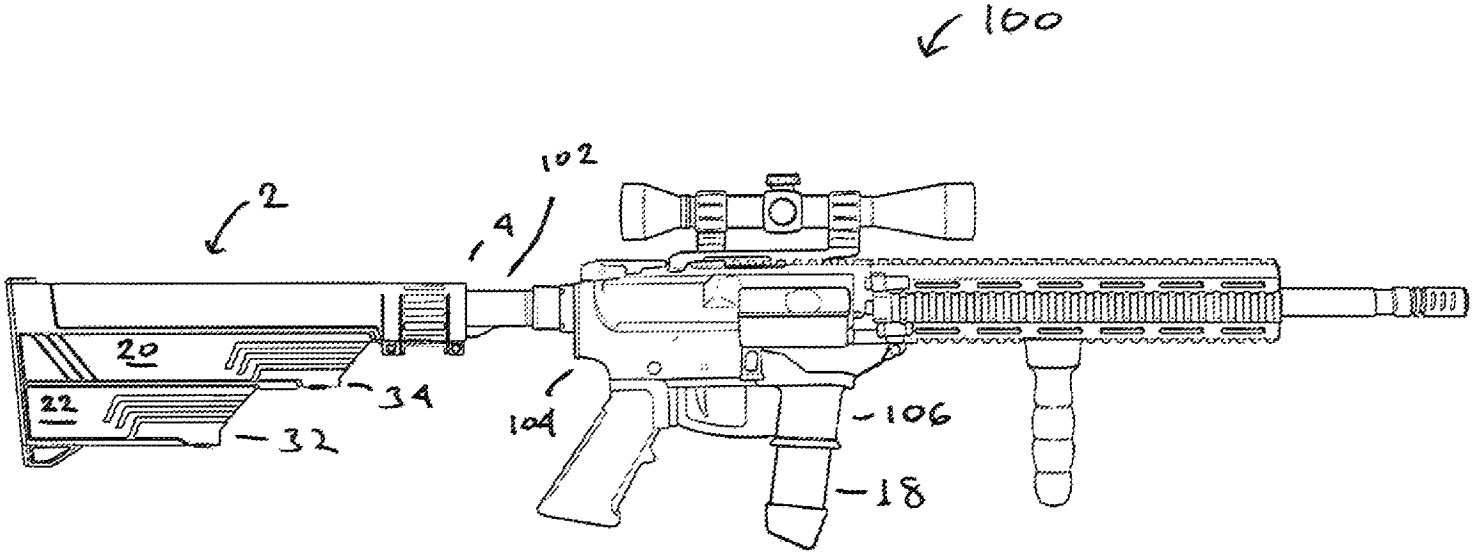
FIG. 2 depicts an embodiment of a firearm depicting how an embodiment of the disclosed buttstock slides onto the buffer tube of the firearm.
Figure 3:
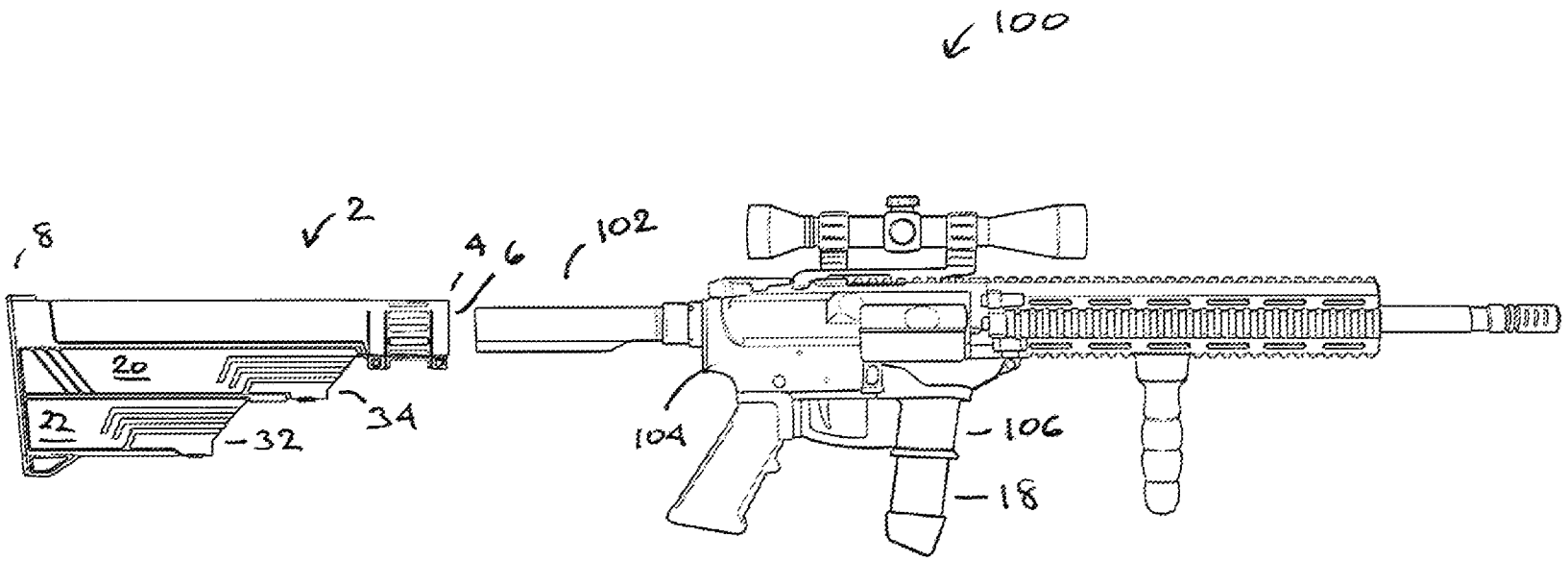
FIG. 3 depicts an embodiment of a firearm with an embodiment of the buttstock removed from the buffer tube of the firearm.
Figure 4:
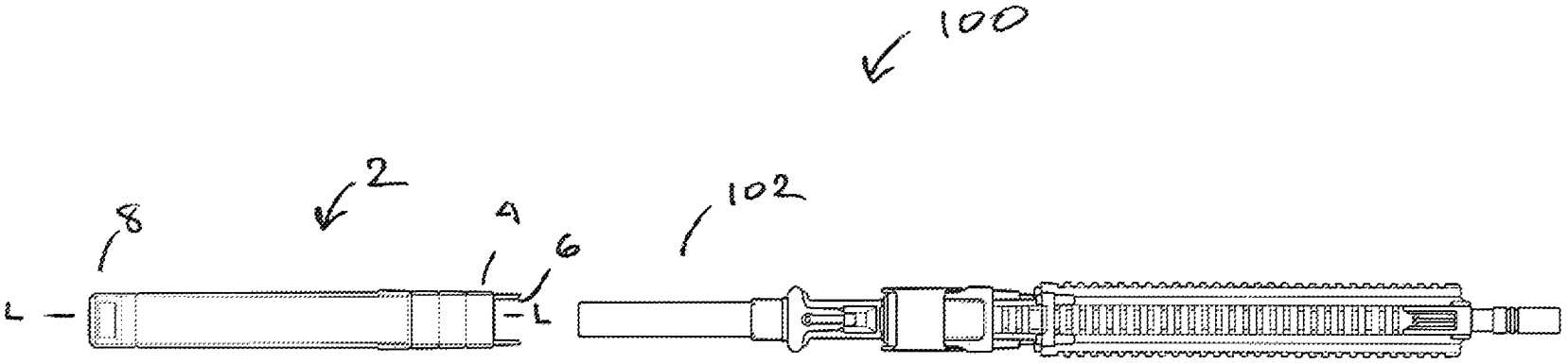
FIG. 4 depicts a top view of an embodiment of a firearm with an embodiment of the buttstock removed from the buffer tube of the firearm.
Figure 5:
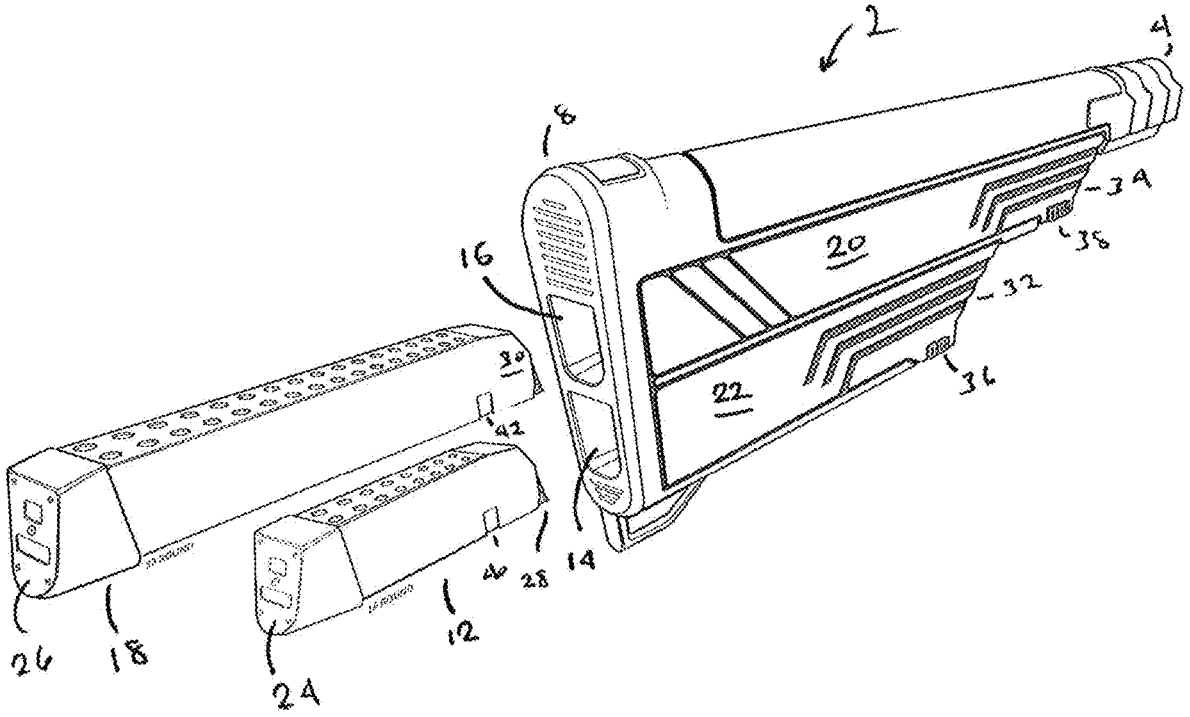
FIG. 5 depicts a perspective view of an embodiment of a buttstock of the present invention having storage slots for two ammunition magazines with both magazines removed.
Figure 6:
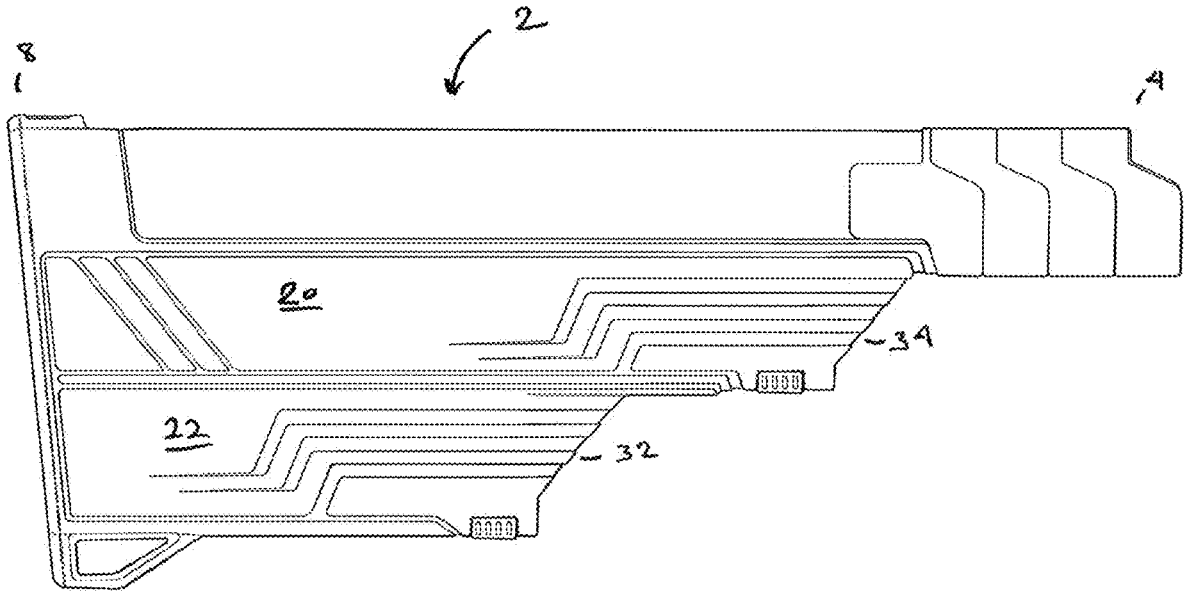
FIG. 6 depicts a side view of an embodiment of a buttstock of the present invention.
Figure 7:
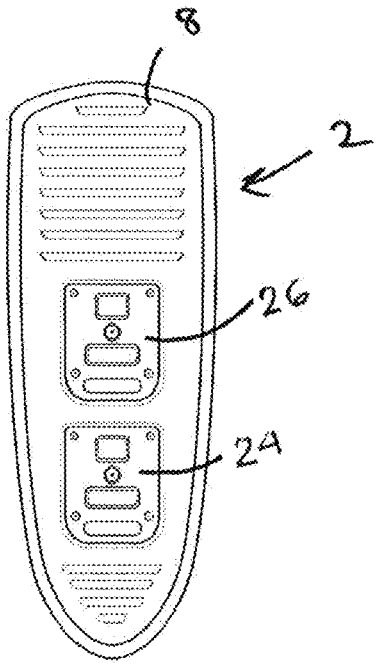
FIG. 7 depicts a rear view of an embodiment of the buttstock of the present invention having two storage slots with an ammunition magazine disposed in each slot.
Figure 8:
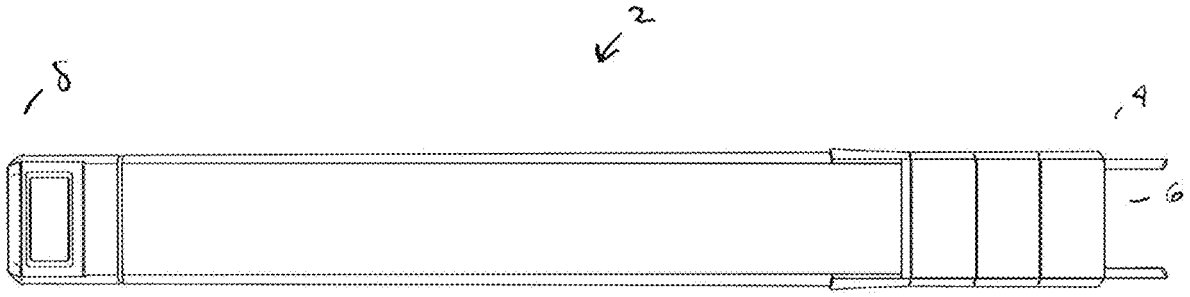
FIG. 8 depicts a top view of an embodiment of a buttstock of the present invention.

Referring now to the Figures, a buttstock 2 of the present invention is shown attached to a firearm 100 in FIG. 1. As indicated above, firearm 100 may comprise a GLOCK rifle configured to receive, among other possibilities, 9-millimeter, 40 caliber and 357 Sig rounds of ammunition. Buttstock 2 has a front end 4 having an opening 6 which receives buffertube 102 of firearm 100, so that embodiments of the present invention are readily attached to a firearm 100 as generally configured in FIGS. 1-4. Buttstock 2 also has rear end 8 wherein a longitudinal axis L is defined between front end 4 and rear end 8.

Firearm 100 has a receiver 104 which is connected to buffertube 102. Firearm 100 also has a magazine receptacle 106. Buttstock 2 has storage capacity for storing spare ammunition magazines 12, 18 where the magazines slide fully into magazine slots 14, 16 leaving only the bottoms 24, 26 of the magazines 12, 18 exposed with tops 28, 30 of the ammunition magazines inserted into magazine slots 14, 16. Magazine slots 14, 16 are generally rectangular having openings configured to receive ammunition magazines 12, 18, with magazine slots 14, 16 extending from the rear end 8 to the front end 8 in parallel alignment with longitudinal axis L. Magazine slots 14, 16 terminate at a front wall 32, 34 which encloses tops 28, 30 of the ammunition magazines 12, 18.

Magazines 12, 18 may either each be empty or, alternatively, may contain up to its full capacity of rounds of ammunition, such as sixteen rounds in lower magazine 12 and thirty-three rounds in upper magazine 18. Embodiments of the buttstock 2 may have the magazine slots 14, 16 configured in an over-under configuration as depicted in the figures. Alternatively, embodiments of the buttstock 2 may comprise a single slot which is configured, depending on the location in the buttstock, the magazine is either the smaller magazine 12 or the larger magazine 18.

The embodiment of the buttstock 2 shown in FIG. 1 has the ammunition magazine 18 removed from the upper magazine slot 16 while a lower magazine slot 14 has an ammunition magazine 12 fully inserted into the slot. As indicated in the figures, magazine slot 16 may be configured to be longer than magazine slot 14 because the upper portion 20 of buttstock 2 will typically be longer than the lower portion 22 of the buttstock.

Embodiments of buttstock 2 may comprise a release mechanism 36, 38 which lockingly retain, respectively, ammunition magazines 12, 18 within the respective magazine slots 14, 16 when the magazine is fully inserted within the slot. Release mechanisms 36, 38 respectively prevent the magazines 12,18 from falling out of the slots. Each release mechanism 36, 38 has an interior catch each which engages a slot 40, 42 in ammunition magazines 12, 18.

Buttstocks of the present invention may be fabricated from a variety of materials, including hard-impact plastic, carbon fiber or wood.

Having thus described the preferred embodiment of the invention, what is claimed as new and desired to be protected by Letters Patent includes the following:

1. A buttstock for a firearm comprising:

a front end having an opening which receives a buffertube of a firearm receiver and a rear end wherein a longitudinal axis is defined there-between;

a first magazine slot extending from the rear end forward towards the front end, the first magazine slot in parallel alignment with the longitudinal axis, the first slot terminating at a first front wall adjacent the front end, the first magazine slot configured to receive a first ammunition magazine having a top and a bottom, wherein the magazine is configured to hold rounds of ammunition in a stack disposed between the top and the bottom, the first magazine slot so configured that when the first ammunition magazine is fully disposed within the first magazine slot, the top abuts the first front wall; and a first mechanism having a first interior catch which lockingly engages the first ammunition magazine when it is fully disposed within the first magazine slot, wherein the first mechanism releases the first ammunition magazine upon a user depressing an outside surface of the first mechanism.

2. The buttstock of claim 1 wherein the bottom of the first ammunition magazine is flush with the rear end of the buttstock when the first ammunition magazine is fully disposed within the first magazine slot.

3. The buttstock of claim 1 further comprising a second magazine slot extending from the rear end forward towards the front end, the second end terminating at a second front wall adjacent the front end, the second magazine slot in a parallel relationship to the first magazine slot.

4. The buttstock of claim 3 wherein the second magazine slot is configured to receive a second ammunition magazine having a top end and a bottom end, such that when the second ammunition magazine is fully disposed within the second magazine slot, the top end abuts the second front wall.

5. The buttstock of claim 4 further comprising a second mechanism having a second interior catch which lockingly engages the second ammunition magazine when it is fully disposed within the second magazine slot, wherein the second mechanism releases the second ammunition magazine upon the user depressing an outside surface of the second mechanism.

6. The buttstock of claim 1 wherein the first ammunition magazine has a capacity to hold up to a total of 32 rounds of ammunition.

7. The buttstock of claim 4 wherein the second ammunition magazine has a capacity to hold up to a total of 16 rounds of ammunition.

8. The buttstock of claim 3 wherein the first magazine slot and the second magazine slot are disposed in an over-under configuration within the buttstock.

9. The buttstock of claim 1 wherein the firearm is a rifle.

10. The buttstock of claim 1 wherein the rounds of ammunition are selected from the group consisting of nine-millimeter, ten-millimeter 40 caliber, 357 sig, and 45 acp.

11. A buttstock for a firearm comprising:

a front end and a rear end;

a first magazine slot extending from the rear end forward towards the front end, the first magazine slot configured to receive a first ammunition magazine having a top and a bottom such that when the first ammunition magazine is fully disposed within the first magazine slot with the top adjacent the front end, the bottom is flush with the rear end of the buttstock; and a second magazine slot extending from the rear end forward towards the front end, the second magazine slot parallel to the first magazine slot with the first magazine slot and the second magazine slot in an over-under configuration; the second magazine slot configured to receive a second ammunition magazine having a top end and a bottom end such that when the second ammunition magazine is fully disposed within the second magazine slot with the top end is adjacent the front end, the bottom end is flush with the rear end of the buttstock.

12. The buttstock of claim 11 further comprising a first mechanism having a first interior catch which lockingly engages the first ammunition magazine when it is fully disposed within the first magazine slot, wherein the first mechanism releases the first ammunition magazine upon a user depressing a first outside surface of the first mechanism, the buttstock further comprising a second mechanism having a second interior catch which lockingly engages the second ammunition magazine when it is fully disposed within the second magazine slot, wherein the second mechanism releases the second ammunition magazine upon the user depressing an outside surface of the second mechanism.

13. The buttstock of claim 11 wherein the first ammunition magazine has a capacity to hold up to a total of 32 rounds of ammunition and the second ammunition magazine has a capacity to hold up to a total of 16 rounds of ammunition.

14. The buttstock of claim 11 wherein the firearm is a rifle.

15. The buttstock of claim 11 wherein the first ammunition magazine is configured to receive ammunition selected from the group consisting of nine-millimeter, ten-millimeter 40 caliber, 357 sig, and 45 acp.

16. A buttstock for a firearm comprising:

a top section, a bottom section, and an intermediate section there-between, the top section having a first axial length, the intermediate section having a second axial length, and the bottom section having a third axial length, wherein the first axial length is greater than the second axial length and the second axial length is greater than the third axial length;

a first magazine slot axially disposed in the intermediate section, the first magazine slot configured to receive a first ammunition magazine having a top and a bottom such that when the first ammunition magazine is fully disposed within the first magazine slot the bottom is flush with a rear end of the intermediate section of the buttstock; and a second magazine slot axially disposed in the bottom section, the second magazine slot parallel to the first magazine slot with the first magazine slot and the second magazine slot in an over-under configuration; the second magazine slot configured to receive a second ammunition magazine having a top end and a bottom end such that when the second ammunition magazine is fully disposed within the second magazine slot, the bottom end is flush with a rear end of the bottom section of the buttstock.

17. The buttstock of claim 16 further comprising a first mechanism having a first interior catch which lockingly engages the first ammunition magazine when it is fully disposed within the first magazine slot, wherein the first mechanism releases the first ammunition magazine upon a user depressing a first outside surface of the first mechanism, the buttstock further comprising a second mechanism having a second interior catch which lockingly engages the second ammunition magazine when it is fully disposed within the second magazine slot, wherein the second mechanism releases the second ammunition magazine upon the user depressing an outside surface of the second mechanism.

18. The buttstock of claim 16 wherein the first ammunition magazine has a capacity to hold up to a total of 33 rounds of nine-millimeter ammunition and the second ammunition magazine has a capacity to hold up to a total of 16 rounds of nine-millimeter ammunition.

19. The buttstock of claim 16 wherein the firearm is a rifle.

20. The buttstock of claim 16 wherein the first ammunition magazine is configured to receive ammunition selected from the group consisting of nine-millimeter, ten-millimeter 40 caliber, 357 sig, and 45 acp.

* * * * *